US007658838B2

(12) United States Patent
Varadaraj et al.

(10) Patent No.: US 7,658,838 B2
(45) Date of Patent: Feb. 9, 2010

(54) DELAYED COKING PROCESS FOR PRODUCING FREE-FLOWING COKE USING POLYMERIC ADDITIVES

(75) Inventors: Ramesh Varadaraj, Flemington, NJ (US); Michael Siskin, Randolph, NJ (US); Leo D. Brown, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 613 days.

(21) Appl. No.: 11/127,822

(22) Filed: May 12, 2005

(65) Prior Publication Data

US 2005/0263440 A1 Dec. 1, 2005

Related U.S. Application Data

(63) Continuation-in-part of application No. 10/846,034, filed on May 14, 2004, now Pat. No. 7,303,664.

(60) Provisional application No. 60/471,324, filed on May 16, 2003.

(51) Int. Cl.
*C10G 9/00* (2006.01)

(52) U.S. Cl. ..... 208/131; 208/13; 208/50; 208/132; 201/21; 201/28

(58) Field of Classification Search ..... 208/13, 208/50, 131, 132; 201/21, 28
See application file for complete search history.

(56) References Cited

U.S. PATENT DOCUMENTS

| | | | | |
|---|---|---|---|---|
| 2,626,207 | A | 1/1953 | Wies et al. | |
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |

(Continued)

FOREIGN PATENT DOCUMENTS

| | | |
|---|---|---|
| EP | 0031697 | 7/1981 |

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—In Suk Bullock
*Assistant Examiner*—Prem C. Singh
(74) *Attorney, Agent, or Firm*—Gerard J. Hughes; W. Robinson H. Clark

(57) ABSTRACT

A delayed coking process for making substantially free-flowing coke, preferably shot coke. A coker feedstock, such as a vacuum residuum, is heated in a heating zone to coking temperatures then conducted to a coking zone wherein volatiles are collected overhead and coke is formed. At least one polymeric additive is added to the feedstock prior to it being heated in the heating zone, prior to its being conducted to the coking zone, or both.

9 Claims, 3 Drawing Sheets

U.S. PATENT DOCUMENTS

| | | | | |
|---|---|---|---|---|
| 4,226,805 | A | 10/1980 | Bauer | |
| 4,298,455 | A | 11/1981 | Huang | 208/48 AA |
| 4,399,024 | A | 8/1983 | Fukui et al. | 208/131 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,460,493 | A * | 7/1984 | Lomas | 516/124 |
| 4,478,729 | A | 10/1984 | Hunt et al. | |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,619,756 | A | 10/1986 | Dickakian | |
| 4,659,453 | A | 4/1987 | Kukes et al. | 208/108 |
| 4,847,018 | A | 7/1989 | Koepke et al. | |
| 4,927,561 | A | 5/1990 | Forester | 252/389.22 |
| 4,966,679 | A | 10/1990 | Kubo et al. | |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A | 3/1994 | Kriz et al. | |
| 5,460,714 | A | 10/1995 | Fixari et al. | 208/112 |
| 5,645,711 | A | 7/1997 | Hraban et al. | 208/131 |
| 5,650,072 | A | 7/1997 | McClain et al. | |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 7,303,664 | B2 * | 12/2007 | Siskin et al. | 208/131 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 175511 | 6/1988 |
| EP | 0839782 A1 | 5/1998 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

DELAYED COKING PROCESS FOR PRODUCING FREE-FLOWING COKE USING POLYMERIC ADDITIVES

CROSS-REFERENCE TO RELATED APPLICATIONS

This application is a continuation-in-part of U.S. patent application Ser. No. 10/846,034 filed May 14, 2004 now U.S. Pat. No. 7,303,664, which claims benefit of U.S. Provisional Patent Application Ser. No. 60/471,324 filed May 16, 2003.

FIELD OF THE INVENTION

The present invention relates to a delayed coking process for making substantially free-flowing coke, preferably free-flowing shot coke. A coker feedstock, such as a vacuum residuum, is heated in a heating zone to coking temperatures then conducted to a coking zone wherein volatiles are collected overhead and coke is formed. A suitable polymeric additive is added to the feedstock prior to it being heated in the heating zone, prior to its being conducted to the coking zone, or both, to enhance the formation of free-flowing coke.

DESCRIPTION OF RELATED ART

Delayed coking involves the thermal decomposition of petroleum residua (reside) to produce gas, liquid streams of various boiling ranges, and coke. Delayed coking of resids from heavy and heavy sour (high sulfur) crude oils is carried out primarily as a means for disposing of these low value feedstocks by converting part of the resid to more valuable liquid and gaseous products. Although the resulting coke is generally thought of as a low value by-product, it may have some value, depending on its grade, as a fuel (fuel grade coke), for electrodes for aluminum manufacture (anode grade coke), etc.

In the delayed coking process, the feedstock is rapidly heated in a fired heater or tubular furnace. The heated feedstock is then passed to a coking drum that is maintained at conditions under which coking occurs, generally at temperatures above about 400° C. under super-atmospheric pressures. The heated residuum feed in the coker drum also forms volatile components that are removed overhead and passed to a fractionator, leaving coke behind. When the coker drum is full of coke, the heated feed is switched to another drum and hydrocarbon vapors are purged from the coke drum with steam. The drum is then quenched with water to lower the temperature to less than about 300° F. (149° C.) after which the water is drained. When the cooling and draining steps are complete, the drum is opened and the coke is removed after drilling and/or cutting using high velocity water jets.

A hole is typically bored through the center of the coke bed using high pressure jets of water from nozzles located on a boring tool. Nozzles oriented horizontally on the head of a cutting tool then cut the coke from the drum. The coke removal step adds considerably to the throughput time and cost of the overall process. Thus, it would be desirable to be able to produce a free-flowing coke, in a coker drum, that would not require the expense and time associated with conventional coke removal.

Even though the coker drum may appear to be completely cooled, areas of the drum do not completely cool. This phenomenon, sometimes referred to as "hot drum", may be the result of a combination of morphologies of coke being present in the drum, which may contain a combination of more than one type of solid coke product, i.e., needle coke, sponge coke and shot coke. Since unagglomerated shot coke may cool faster than other coke morphologies, such as large shot coke masses or sponge coke, it would be desirable to produce predominantly substantially free-flowing coke, preferably shot coke, in a delayed coker, in order to avoid or minimize hot drums.

SUMMARY OF THE INVENTION

In an embodiment, there is provided a delayed coking process comprising:

(a) heating a petroleum resid in a first heating zone, to a temperature below coking temperatures but at a temperature wherein the resid is a pumpable liquid;

(b) conducting said heated resid to a second heating zone wherein it is heated to coking temperatures;

(c) conducting said heated resid from said second heating zone to a coking zone wherein vapor products are collected overhead and a solid coke product is formed;

(d) introducing into said resid at least one polymeric additive that is effective for the formation of substantially free-flowing coke, wherein said polymeric additive is introduced into said resid at a point upstream of the second heating zone, between said second heating zone and said coking zone, or both.

In a preferred embodiment, the coking zone is in a delayed coker drum, and a substantially free-flowing shot coke product is formed.

In another embodiment, there is provided a delayed coking process comprising:

(a) contacting a vacuum resid with an effective amount of at least one polymeric additive at a temperature from about 70° C. to about 370° C. for a time sufficient to disperse the additive substantially uniformly into the feed;

(b) heating the contacted vacuum resid to a temperature effective for coking said feed;

(c) charging said heated vacuum resid to a coking zone at a pressure from about 15 to 80 psig for an effective amount of time to allow a bed of hot coke to form, at least a portion of which is free-flowing; and (d) quenching at least a portion of the bed of hot coke with water.

In another embodiment, the polymeric additive is selected from the group consisting of polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof. The polymeric additive will preferably have a molecular weight range of about 1,000 to 30,000, more preferably about 1,000 to 10,000. The co-polymers are preferably block copolymers. Illustrative examples of the polymers are given in FIGS. 1 and 2 hereof.

In another embodiment a substantially free-flowing shot coke product is formed and removed from the coking zone. The coking zone is preferably a delayed coker drum. The additive can be incorporated and combined with the feed either before the feed is introduced into the heating zone, which is a coker furnace, or it can be introduced into the feed between the coker furnace and coker drum. It is also within the scope of this invention that the additive be introduced into the feed in both locations. The same additive, or additives, can be added independently at each location or a different additive or additives can be added at each location.

Use of the term "combine" and "contact" are meant in their broad sense, i.e., that in some cases physical and/or chemical changes in the additive and/or the feed can occur in the additive, the feed, or both when additive is present in the feed. In other words, the invention is not restricted to cases where the additive and/or feed undergo no chemical and/or physical change following, or in the course of, the contacting and/or combining. An "effective amount" of additive is the amount of additive(s) that when contacted with the feed would result in the formation of free-flowing coke in the coking zone, preferably substantially free-flowing shot coke. An effective amount typically will ranges from about 100 to about 100,000 ppm (based on the total weight of the feed). Of course, the amount used will depend on the particular additive species used and its chemical and physical form. The effective amount will typically be less for additives species in a physical and chemical form that lead to better dispersion in the feed than for additive species that are more difficult to disperse. Thus, additives that are at least partially soluble in organics, more preferably in the resid feed, are most preferred.

Uniform dispersal of the additive into the resid feed is desirable to avoid heterogeneous areas of coke morphology formation. That is, one does not want locations in the coke drum where the coke is substantially free flowing and other areas where the coke is substantially non-free flowing. Dispersing of the additive is accomplished by any suitable technique, preferably by introducing a side stream of the additive into the feed at the desired location. The additive can be added by solubilization of the additive into the resid feed. Reducing the viscosity of the resid prior to mixing in the additive, e.g., by heating, solvent addition, etc., will facilitate solubilization of the additive into the resid feed. High energy mixing, or use of static mixing devices may be employed to assist in dispersal of the additive, especially additives that have relatively low solubility in the feedstream.

Preferably, all or substantially all of the coke formed in the process of the present invention is substantially free-flowing coke, more preferably, substantially free-flowing shot coke. It is also preferred that at least a portion of volatile species present in the coker drum during and after coke formation be separated and conducted away from the process, preferably overhead of the coker drum.

Figure 1:
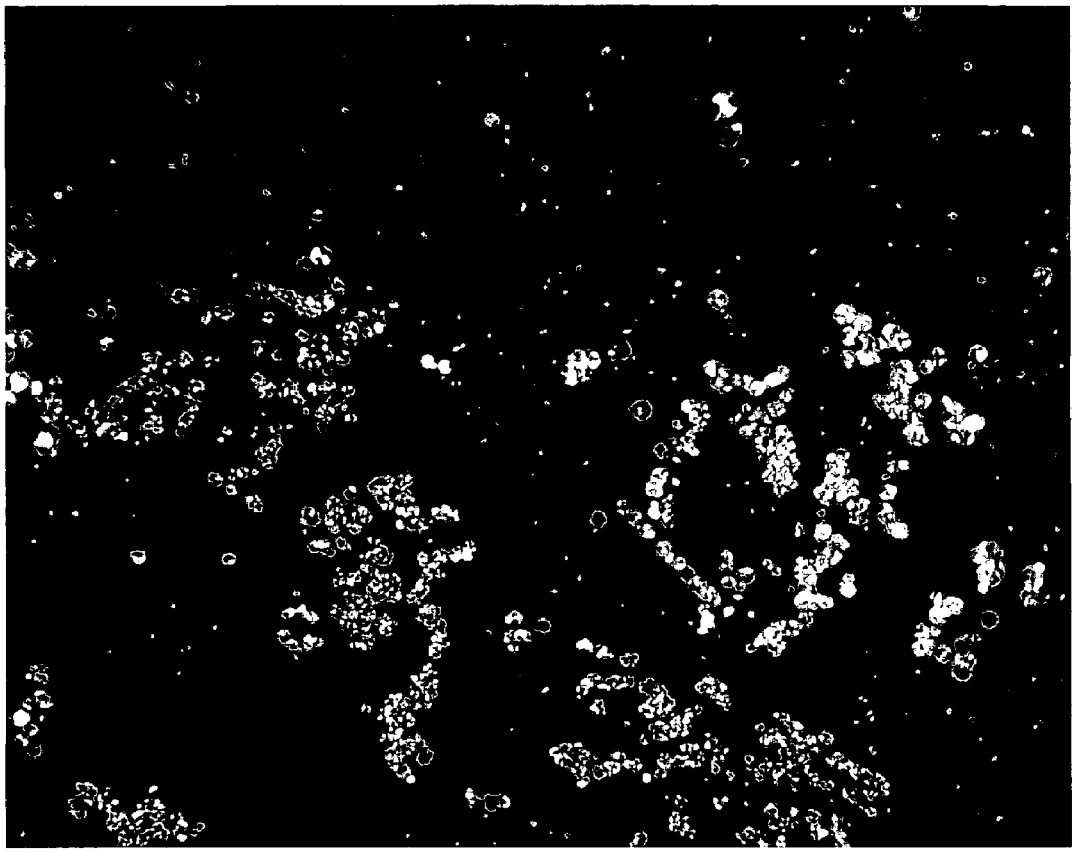
FIG. 1 hereof is an optical micrograph showing the residue of the example hereof wherein no additive was used.

All photomicrographs in these Figures used cross-polarized light optical microscopy, with a viewing area of 170 by 136 micrometers.

DETAILED DESCRIPTION OF THE INVENTION

Petroleum vacuum residua ("resid") feedstocks are suitable for delayed coking. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

In an embodiment, resid feedstocks include, but are not limited to, residues from the atmospheric and vacuum distillation of petroleum crudes or the atmospheric or vacuum distillation of heavy oils, visbroken resids, coal liquids, shale oil, tars from deasphalting units or combinations of these materials. Atmospheric and vacuum topped heavy bitumens can also be employed. Typically, such feedstocks are high-boiling hydrocarbonaceous materials having a nominal initial boiling point of about 538° C. or higher, an API gravity of about 20° or less, and a Conradson Carbon Residue content of about 0 to 40 weight percent.

Resid feeds are typically subjected to delayed coking. Generally, in delayed coking, a residue fraction, such as a petroleum residuum feedstock is pumped to a heater at a pressure of about 50 to 550 psig, where it is heated to a temperature from about 480° C. to about 520° C. It is then discharged into a coking zone, typically a vertically-oriented, insulated coker drum through an inlet at the base of the drum. Pressure in the drum is usually relatively low, such as about 15 to 80 psig to allow volatiles to be removed overhead. Typical operating temperatures of the drum will be between about 410° C. and 475° C. The hot feedstock thermally cracks over a period of time (the "coking time") in the coker drum, liberating volatiles composed primarily of hydrocarbon products, that continuously rise through the coke mass (bed) and are collected overhead. The volatile products are sent to a coker fractionator for distillation and recovery of coker gases, naphtha, light gas oil, and heavy gas oil fractions. In an embodiment, a small portion of the heavy coker gas oil present in the product stream introduced into the coker fractionator can be captured for recycle and combined with the fresh feed (coker feed component), thereby forming the coker heater or coker furnace charge. In addition to the volatile products, delayed coking also forms solid coke product.

There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Shot coke is considered the lowest quality coke. The term "shot coke" comes from its shape which is similar to that of BB sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and this refers to a coke having a morphology between that of sponge coke and shot coke or composed of a mixture of shot coke bonded to sponge coke. For example, coke that has a mostly sponge-like physical appearance, but with evidence of small shot spheres beginning to form as discrete shapes.

Substantially free-flowing shot coke can be produced in accordance with the present invention by treating the residuum feedstock with one or more polymeric additives. The additives are those that enhance the production of shot coke during delayed coking. The resid feed is subjected to treatment with one or more additives, at effective temperatures, i.e., at temperatures that will encourage the additives' dispersal in the feed stock. Such temperatures will typically be from about 70° C. to about 500° C., preferably from about 150° C. to about 370° C., more preferably from about 185° C. to about 350° C.

Non-limiting examples of polymeric additives of the present invention include those selected from the group consisting of polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof.

The polymeric additive will be used in an effective amount. That is, in at least that amount that will result in a desired degree of free-flowing coke. This amount will typically be from about 300 to about 5000 wppm, preferably from about 300 to about 3000 wppm, and more preferably from about 300 to 2000 wppm, based on the weight of the heavy oil feed.

It is within the scope of this invention that a second type of additive be used in combination with the polymeric additive. This second type of additive will be a metals-containing additive that can be used in liquid or solid form, with liquid form being preferred. Non-limiting examples of metals-containing additives that can be used in the practice of the present invention include metal hydroxides, naphthenates and/or carboxylates, metal acetylacetonates, Lewis acids, a metal sulfide, metal acetate, metal carbonate, high surface area metal-containing solids, inorganic oxides and salts of oxides. Preferred metals of the hydroxides are the alkali and alkaline-earth metals, more preferably potassium and sodium. Salts that are basic are preferred. If a metals-containing additive is used in combination with the polymeric additive, the total amount of both additives will not exceed the maximum amount given for the polymeric additive, which is up to about 5000 wppm.

It is preferred that the fraction of 900° F. to 1040° F. atmospheric equivalent boiling point (AEBP) material be kept under 10 wt. %, which will push coke morphology back to a less bonded and less self-supporting coke morphology.

Rapid drying/coking/disruption of the initially formed liquid mesophase results in formation of liquid spheres that form shot coke. Slow drying of mesophase allows the initially liquid mesophase to spread out and coke in place and result in formation of an extended network of sponge coke. Intermediate drying rates produce transition coke which is a mixture of sponge and shot cokes with the shot coke embedded in the sponge coke. This latter situation can lead to coke eruptions, or "hot drums", when the coke drum of a delayed coker is cut/drilled out because the sponge coke forms a seal embedding shot coke and superheated steam. When the drill hits such a seal it relates the steam and shot coke BBs. It is highly desirable to be able to produce shot or sponge coke in a controlled manner and to avoid formation of transition coke. The refiner can cut out the sponge coke or drain the shot coke without the need for drilling. Addition of the polymeric additive of the present invention enables coking at higher temperature because it slows thermal cross-linking reactions between mesophase layers permitting faster coke drying and formation of shot coke spheres. In addition to higher temperatures, operating the coke drum at lower pressures, e.g., 15 psi vis 45 psi, allows volatile cracking products to escape and minimize their residence time as liquid in the mesophase. The polyether additives are also effective at disrupting heavy oil mesophase formation and cross-linking because they decompose at a slower rate in the coke drum (typically at about 425° C.) than the rate of drying of the coke.

The precise conditions at which the resid feedstock is treated with the additive is feed and additive dependent. That is, the conditions at which the feed is treated with the additive are dependent on the composition and properties of the feed to be coked and the additive used. These conditions can be determined conventionally. For example, several runs can be made with a particular feed containing an additive at different times and temperatures by coking in a bench-scale reactor such as a Microcarbon Residue Test Unit (MCRTU). The resulting coke is then analyzed by use of optical cross-polarized light microscopy as set forth herein. The preferred coke morphology (i.e., one that will produce substantially free-flowing coke) is a coke microstructure of discrete microdomains having an average size of about 0.5 to 10 μm, preferably from about 1 to 5 μm, somewhat like the mosaic shown in FIGS. 2, and 3 hereof. Coke microstructure that represents coke that is not free-flowing shot coke is shown in FIG. 1 hereof, showing a coke microstructure that is composed substantially of non-discrete, or substantially large flow domains up to about 60 μm or greater in size, typically from about 10 to 60 μm.

Conventional coke processing aids, including an antifoaming agent, can be employed in the process of the present invention. While shot coke has been produced by conventional methods, it is typically agglomerated to such a degree that water-jet technology is still needed for its removal.

In one embodiment of the present invention, the resid feedstock is first treated with the polymeric additive of the present invention that encourages the formation of substantially free-flowing coke. By keeping the coker drum at relatively low pressures, much of the evolving volatiles can be collected overhead, which prevents undesirable agglomeration of the resulting shot coke. The combined feed ratio ("CFR") is the volumetric ratio of furnace charge (fresh feed plus recycle oil) to fresh feed to the continuous delayed coker operation. Delayed coking operations typically employ recycles of about 5 vol. % to 25 vol. % (CFRs of about 1.05 to 1.25). In some instances there is 0 recycle and sometimes in special applications recycle up to 200%. CFRs should be low to aid in free-flowing shot coke formation, and preferably no recycle should be used.

Typically, additive(s) are conducted to the coking process in a continuous mode. If needed, the additive can be dissolved or slurried into an appropriate transfer fluid, which will typically be solvent that is compatible with the resid and in which the additive is substantially soluble. The fluid mixture or slurry is then pumped into the coking process at a rate to achieve the desired concentration of additives in the feed. The introduction point of the additive can be, for example, at the discharge of the furnace feed charge pumps, or near the exit of the coker transfer line. There can be a pair of mixing vessels operated in a fashion such that there is continuous introduction of the additives into the coking process.

The rate of additive introduction can be adjusted according to the nature of the resid feed to the coker. Feeds that are on the threshold of producing shot coke may require less additive than those which are farther away from the threshold.

For additives that are difficult to dissolve or disperse in resid feeds, the additive(s) are transferred into the mixing/slurry vessel and mixed with a slurry medium that is compatible with the feed. Non-limiting examples of suitable slurry mediums include coker heavy gas oil, water, etc. Energy may be provided into the vessel, e.g., through a mixer for dispersing the additive.

For additives which can be more readily dissolved or dispersed in resid feeds, the additive(s) are transferred into the mixing vessel and mixed with a fluid transfer medium that is compatible with the feed. Non-limiting examples of suitable fluid transfer mediums include warm resid (temp. between about 150° C. to about 300° C.), coker heavy gas oil, light cycle oil, heavy reformate, and mixtures thereof. Cat slurry oil (CSO) may also be used also, though under some conditions it may inhibit the additives' ability to produce loose shot coke. Energy may provided into the vessel, e.g., through a mixer, for dispersing the additive into the fluid transfer medium.

The present invention will be better understood by reference to the following non-limiting examples that are presented for illustrative purposes.

EXAMPLES

Tetronic and Pluronic polymers available from BASF Corporation were used to illustrate the present invention. These polymeric compounds were co-polymers of ethylene oxide and propylene oxide. The average molecular weight for each polymer additive was about 1500.

Polymeric additive compounds shown below were used in this example. These polymeric compounds are co-polymers of ethylene oxide and propylene oxide and are commercially available. The additive to the left is a Tetronic co-polymer and the one on the right is a Pluronic co-polymer available from BASF Corporation. The average molecular weight for each polymeric additive was about 1500.

2 gms of a Baton Rouge Refinery Vacuum Tower Bottoms were charged into a Microcarbon Reactor Test Unit (MCR). The resid was heated to 400° C. and held at 400° C. for 2 hours and the residue was analyzed gravimetrically. The resid was also run with the addition of 3000 wppm of the two above polymeric additives. Polarized light optical microscopic examination of the residues was conducted. The table below shows the results.

TABLE

| Additive | Resid (g) | Additive, mg | Additive (wppm) | R.T. to 400° C. and held for 4 hrs. |
|---|---|---|---|---|
| None | 4.52 | — | — | 27.38 |
| Pluronic F-108 | 4.20 | 12.80 | 3048 | 26.90 |
| Tetronic 1508 | 4.63 | 13.90 | 3002 | 27.39 |

Figure 2:
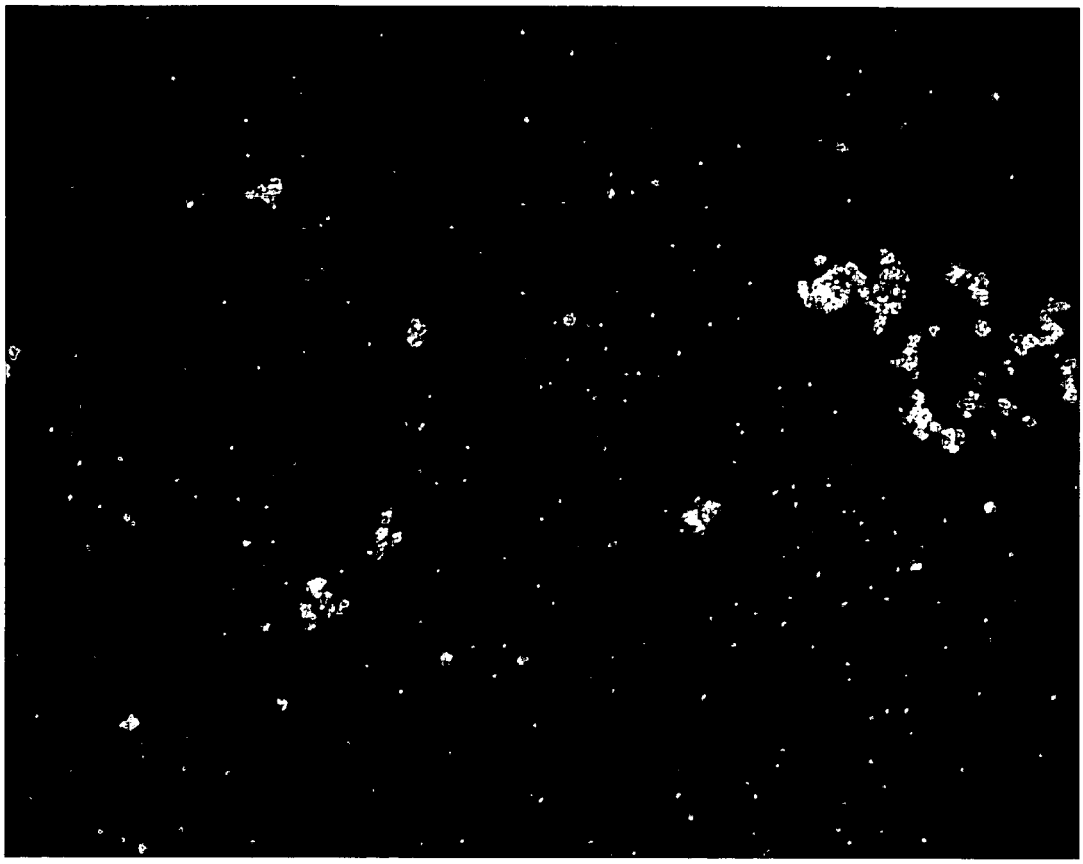
FIG. 2 hereof is an optical micrograph showing the residue of the example hereof wherein the polyoxyethylene-polyoxypropylene (Pluronic) additive was used.
Figure 3:
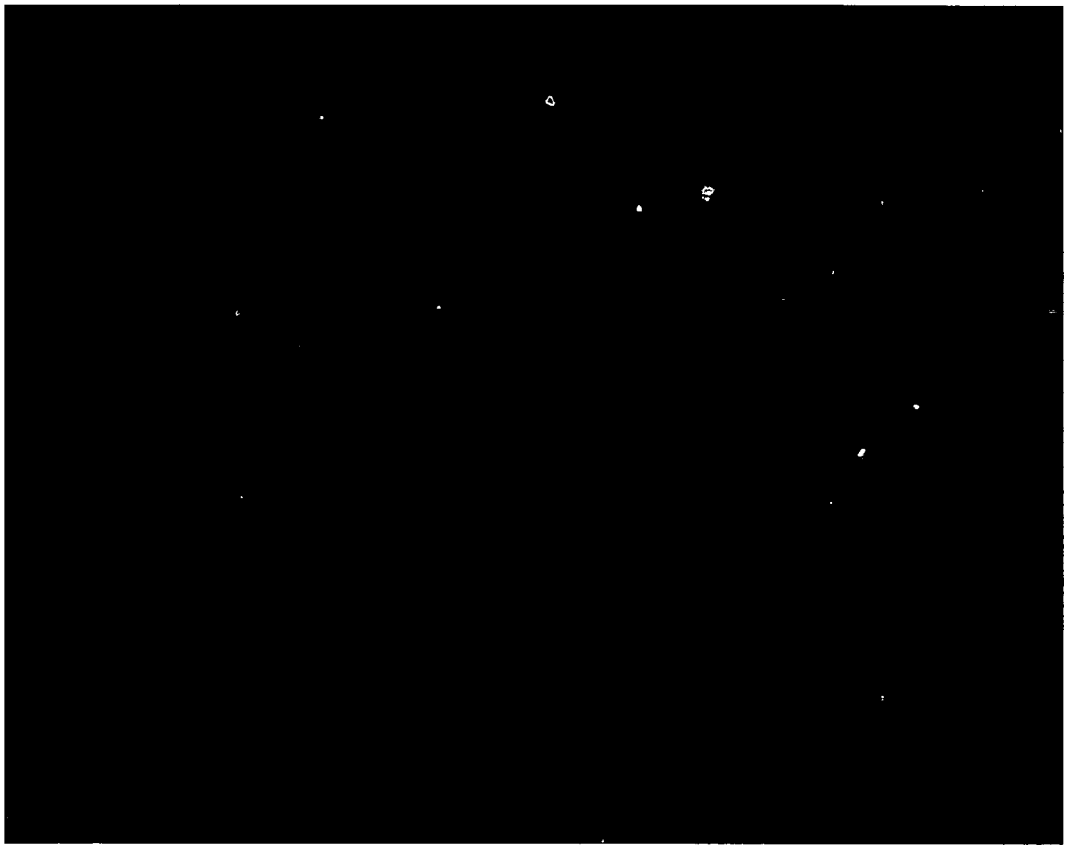
FIG. 3 hereof is an optical micrograph showing the residue of the example hereof wherein the ethylene diamine tetra acetic ester of polyoxyethylene alcohol (Tetronic) additive was used.

The microscopy results are shown in photomicrographs of FIGS. 1, 2, and 3 hereof which demonstrate the effect of the polymeric additives of the present invention. FIG. 1 is the results of no additive and many bright spheres can be observed which indicates the presence of a substantial amount of anisotropic coke. FIG. 2 represents the run made using the polyoxyethylene-polyoxypropylene (Pluronic) where it is observed that relatively few microspheres are present compared to that of FIG. 1, thus indicating the suppression of anisotropic coke. FIG. 3 hereof represents the run make using ethylene diamine tetra alkoxylated alcohol of polyoxyethylene-polyoxypropylene alcohol (Tetronic) wherein it is observed that an isotropic phase is present indicating that anisotropic coke formation has been substantially completely suppressed. Thus, the polymeric additives of the present invention suppress anisotropic coke make and alter the coke morphology.

The invention claimed is:

1. A delayed coking process comprising:

(a) heating a petroleum resid feed in a first heating zone, to a temperature below coking temperatures but to a temperature wherein the resid is a pumpable liquid;

(b) conducting said heated resid to a second heating zone wherein it is heated to coking temperatures;

(c) conducting said heated resid from said second heating zone to a coking zone wherein vapor products are collected overhead and a substantially free-flowing shot coke product is formed;

(d) introducing into said resid from about 300 to about 3,000 wppm of at least one polymeric additive selected from polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof and having a molecular weight from about 1,000 to about 30,000, that is effective for the formation of substantially free-flowing shot coke, wherein said polymeric additive is introduced into said resid at a point upstream of the second heating zone, between said second heating zone and said coking zone, or both.

2. The process of claim 1 wherein the residuum is vacuum resid.

3. The process of claim 2 wherein at least a portion of the additive is soluble in the feedstock.

4. The process of claim 1 wherein the molecular weight of the polymeric additive is from about 1,000 to about 10,000.

5. A delayed coking process comprising:

(a) contacting a vacuum resid feed with an effective amount from about 300 to about 5,000 wppm of at least one polymeric additive selected from polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof and having a molecular weight from about 1,000 to about 30,000, at a temperature from about 70° C. to about 370° C. for a time sufficient to disperse the agent uniformly into the feed;

(b) heating the resid to a temperature effective for coking said feed;

(c) charging said heated vacuum resid to a coking zone at a pressure from about 15 to 80 psig for a coking time to allow a bed of hot coke to form, at least a portion of which is free-flowing; and (d) quenching at least a portion of the bed of hot coke with water to form a substantially free-flowing shot coke product.

6. The process of claim 5 wherein at least a portion of the additive is soluble in the feedstock.

7. The process of claim 5 wherein the effective amount of additive is from about 300 to about 3,000 wppm.

8. The process of claim 5 wherein the molecular weight of the polymeric additive is from about 1,000 to about 10,000.

9. The process of claim 5 wherein the molecular weight of the polymeric additive is from about 1,000 to about 10,000.

* * * * *